United States Patent [19]

Jorgensen

[11] 4,179,174

[45] Dec. 18, 1979

[54] JOINT CLIP ASSEMBLY FOR BUS BARS

[75] Inventor: George N. Jorgensen, Oxford, Ohio

[73] Assignee: Square D Company, Palatine, Ill.

[21] Appl. No.: 951,552

[22] Filed: Oct. 16, 1978

[51] Int. Cl.[2] ..... H01R 7/28

[52] U.S. Cl. ..... 339/22 B; 174/88 B

[58] Field of Search ..... 339/22 R, 22 B, 24, 339/20, 21 R; 174/88 B, 99 B

[56] References Cited

U.S. PATENT DOCUMENTS 3,173,733 3/1965 Weimer et al. ..... 339/22 B 3,478,299 11/1969 Cinatl et al. ..... 339/22 R X

*Primary Examiner*—E. F. Desmond

*Attorney, Agent, or Firm*—Norton Lesser; Larry I. Golden; Richard T. Guttman

[57] ABSTRACT

A spring clip arrangement connecting cylindrical bus bars in tandem comprising a U-shaped spring snap fitted into an insulator recess and a pair of separate metal clips seated therein and interlocked against movement relative the insulator support and the bus bars. Insertion of a bus bar clamps the clips between the spring and the bus bar.

10 Claims, 10 Drawing Figures

JOINT CLIP ASSEMBLY FOR BUS BARS

FIELD OF THE INVENTION

This invention relates in general to clip arrangements for interconnecting bus bars, and more particularly, to an improved and a more economical spring clip arrangement for connecting cylindrical bus bars in tandem.

BACKGROUND OF THE INVENTION

SUMMARY OF THE PRIOR ART

Aluminum or copper bus bars formed as rods are often used for extending electrical circuits in electrical systems. The bus bars carried in a housing assembly or bus way section approximately 10 feet or less in length with each housing commonly carrying either 3 or 4 bars secured by insulators in the respective housing. The housings comprise left and right U-shaped sections in longitudinally offset positions so that the left section extends beyond the right section at one end and the right section extends beyond the left section at the other end to provide complementary housing portions for nesting engagement with succeeding or preceding sections of busway when they are connected in tandem to extend the bars to a desired length. To connect the bus bars of one section with respective bus bars of another section a bus bar or joint clip assembly is provided in one of the extending ends of the housing.

Each clip assembly as shown in U.S. Pat. No. 3,173,733 includes an insulator carried by an extending end of each housing. The insulator in turn carries a U-shaped copper or aluminum clip member for each bus bar and one portion of each clip member grasps one cylindrical end of the respective bus bar and the other portion engages an aligned cylindrical end of a bus bar in another housing. The U-shaped clip is nested between two pair of spaced legs of a U-shaped steel spring member which prevents excessive deformation of the clip and serves to provide the pressure required to ensure electrical continuity between the bars. The described arrangement, however, requires that each clip and spring be fastened to the insulator by an individual fastener or rivet and this requires substantial assembly time in addition to the fastener cost and is therefore relatively expensive.

SUMMARY OF THE INVENTION

The present invention utilizes a spring clip arrangement for the ends of the cylindrical bus bars incorporating a U-shaped spring which is snap fitted between two projections of an insulator and a pair of separate clips having tabs which are simply inserted in passages of the spring. The spring member is thus held against movement relative the insulator by the interlocking projections and likewise the legs of the clip are located between the legs of the U-shaped spring by interlocking tabs and passages. Insertion of the end of a bus bar, which is secured in the housing serves to clamp the clip members against the legs of the spring and prevents movement of the clip and spring member. A second bus bar is then inserted between the clip members to connect the bars in end to end relationship. It is therefore, one object of the present invention to provide a more economical spring clip assembly for extending connections between bus bars.

It is another object of the present invention to provide an improved or more economical joint clip for connecting cylindrical bus bars in end to end relationship.

Another object is to provide a plug-in joint connection that provides proper and reliable spring pressure through the action of a steel spring backup clip without reliance upon or interference from the action of the electrical conducting members.

Other objects and features of the present invention will become apparent on examination of the following specifications and claims together with the drawings.

DESCRIPTION OF THE PREFERRED EMBODIMENT

Figure 1:
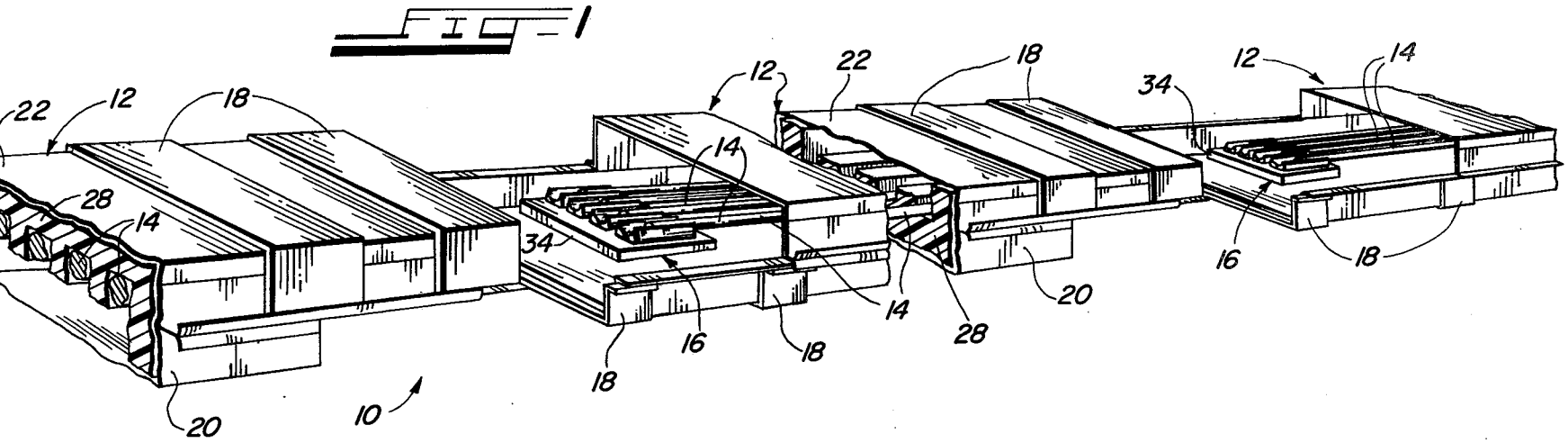
FIG. 1 is an isometric view showing several bus bar housing assemblies incorporating the principles of the present invention and arranged for tandem connection.

In FIG. 1 a portion of a 100 amp busway system is indicated by the reference character 10. The busway or bus bar system 10 is for example, utilized in 277/480 volt, 100 amp systems and includes a plurality of housing assemblies 12 each carrying a plurality of bus bars 14 and having a joint or bus bar clip assembly 16 adjacent one end. The housing assemblies 12 are adapted to be secured to each other at opposite ends by means of respective U-shaped straps 18 while each clip assembly 16 interconnects the respective bus bars adjacent their respective ends for extending electrical connections between respective cylindrical bus bars 14. Thus each cylindrical bus bar 14 in a respective housing assembly 12 may be connected in series or tandem with a bar in another assembly to extend respective electrical connections between a source and a load. Usually either three phase bars and one neutral bus bar or three phase bars only are provided in each assembly, although other bus bar arrangements may be used for specific requirements, and the number of assemblies is selected in accordance with the required length.

Figure 4:
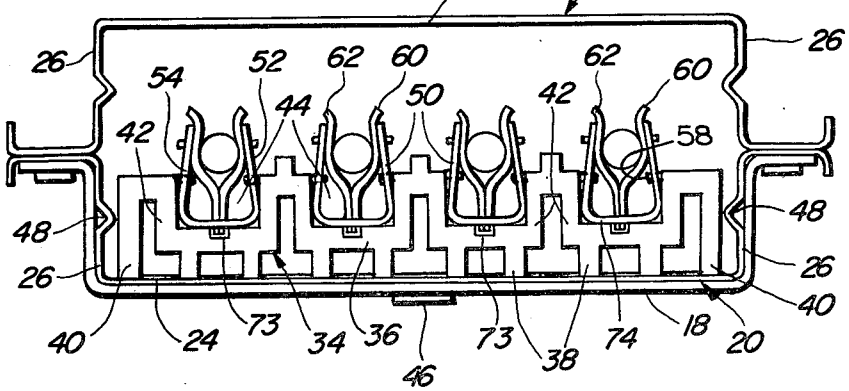
FIG. 4 is an end elevational view of one housing assembly illustrating the spring clip assembly.

Each housing assembly or section 12 comprises a right U-shaped sheet metal member or section 20 and left U-shaped sheet metal member or section 22 of similar construction each having a side wall 24 and top or bottom walls 26 as best seen in FIG. 4. Flanges are formed on the ends of the walls 26 and the flanges extend laterally outwardly from the walls to enable the housing members to be fastened together with their side walls 24 spaced apart. Conventional insulating members 28 located between the members 20 and 22 serve to secure the bus bars in the housing section against movement transverse to the longitudinal axis of the housing assemblies. The insulating members 28 usually comprise legs extending between walls 24 and legs on adjacent insulating members may extend in opposite directions to define recesses capturing each bar against transverse movement.

The left and right members 20 and 22 are longitudinally offset from each other so that one end of the right housing member 20 extends at one end beyond the corresponding end of the left housing member 22 and one end of the left housing member 22 extends at the other end beyond the corresponding end of the right member. The end of each member is thus overlappingly or nestingly engaged with the end of either a left or right member respectively of a housing assembly to be connected in series or tandem therewith.

The bus bars 14, which are substantially 9/32 diameter rods, extend longitudinally of the respective housing assemblies to a position intermediate to the extending end of each right and left housing member and are supported in spaced relationship between the housing members by the spaced insulators 28. Plug-in units may be connected to the bus bars intermediate the ends of the housing assemblies at doors or knockouts, which are conventionally employed in such housing assemblies.

Figure 3:
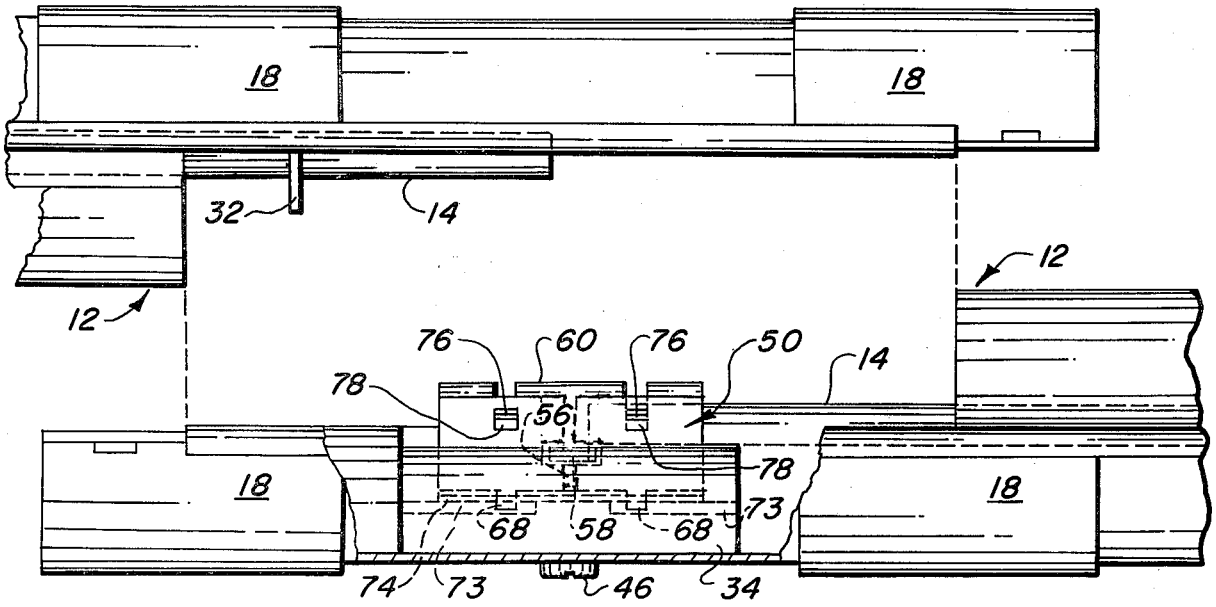
FIG. 3 illustrates the complementary portions at the mating ends of two housing assemblies arranged for engagement with each other with a portion of the lower housing assembly partially broken away.
Figure 6:
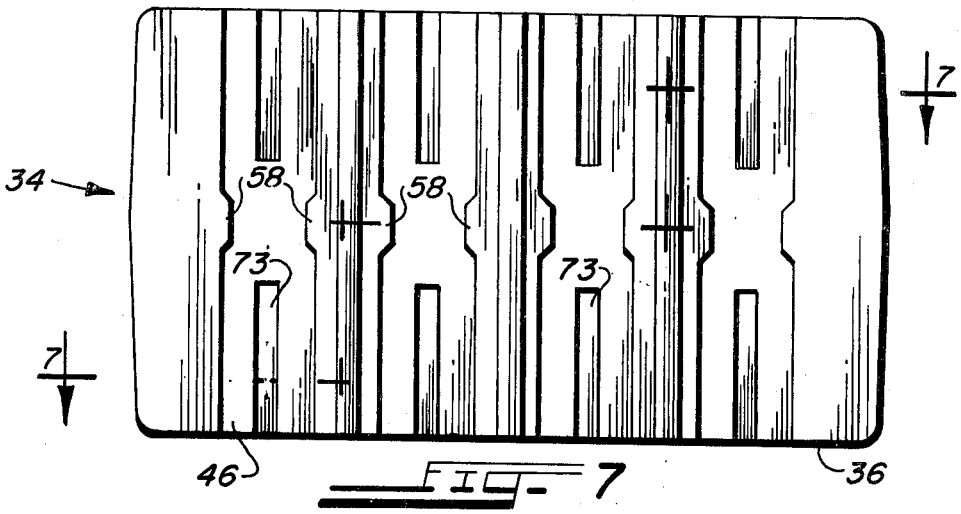
FIG. 6 is the top elevational view of the insulator used in the spring clip assembly.
Figure 7:
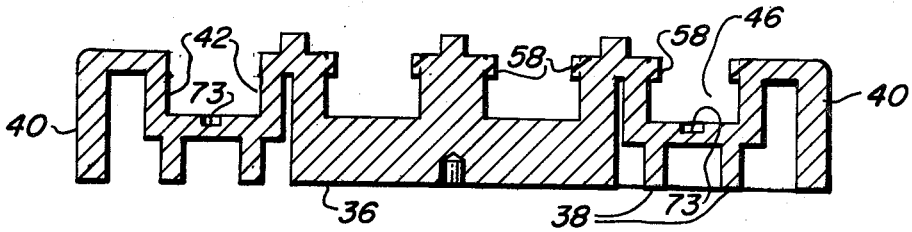
FIG. 7 is a sectional view of the insulator taken along the line 7—7 in FIG. 6.
Figure 8:
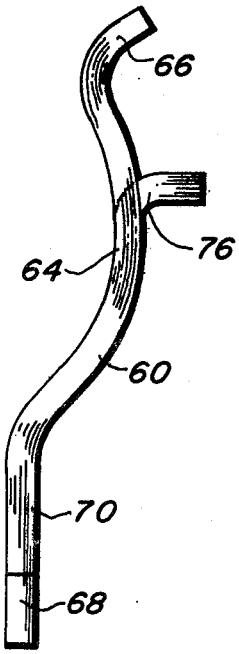
FIG. 8 is an end elevational view of one of the clip members.
Figure 9:
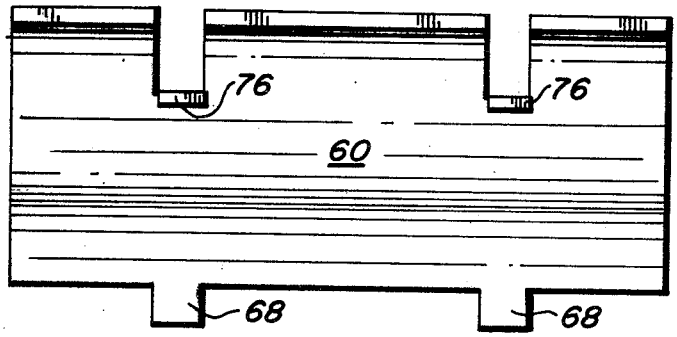
FIG. 9 is a side elevational view of one of the clip members.
Figure 10:
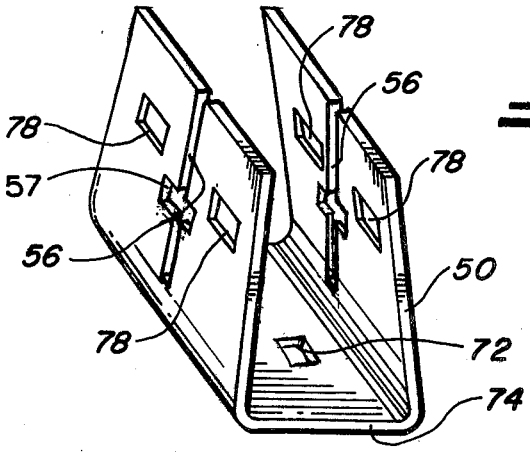
FIG. 10 is an isometric view of the spring member used in the clip assembly.

The bus bars 14 at the extending end of each right housing member 20 are received in a respective joint clip assembly 16 for enabling the facile electrical connection of the bus bars of one housing to respective bus bars of another housing assembly supported by an insulating support such as 32 in the extending end of each upper housing member as seen in FIG. 3.

Each clip assembly 16 comprises an electrically insulating base or member 34 having a convoluted wall 36 defining a plurality of spaced lower or depending legs 38 and end legs 40 seated against wall 24 of section 20 and a plurality of spaced apart upper legs 42 defining recesses 44 each aligned with a respective bus bar and extending longitudinally of the bus bars. The insulating member 34 is secured by means of a fastener 46 adjacent its central axis to the side wall 24 of a housing member and projections 48 formed on the top and bottom walls 26 of the housing member engage end legs 40 of the member 34 to hold the same against rotation and to compensate for dimensional differences.

Figure 5:
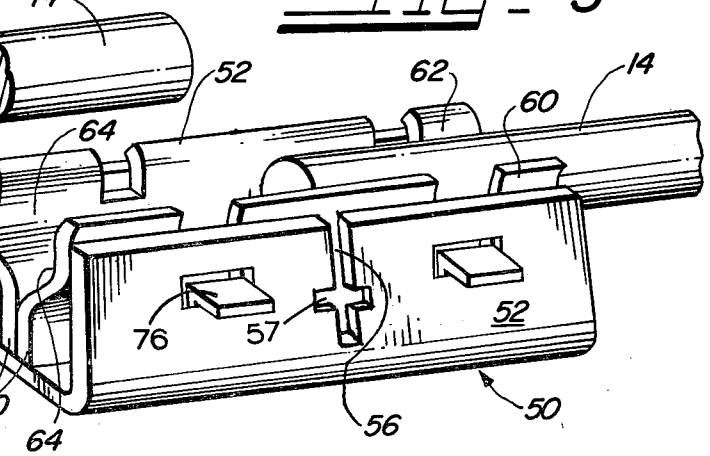
FIG. 5 is a fragmentary isometric view illustrating the manner in which the spring clip assembly interconnects the bars.
Figure 2:
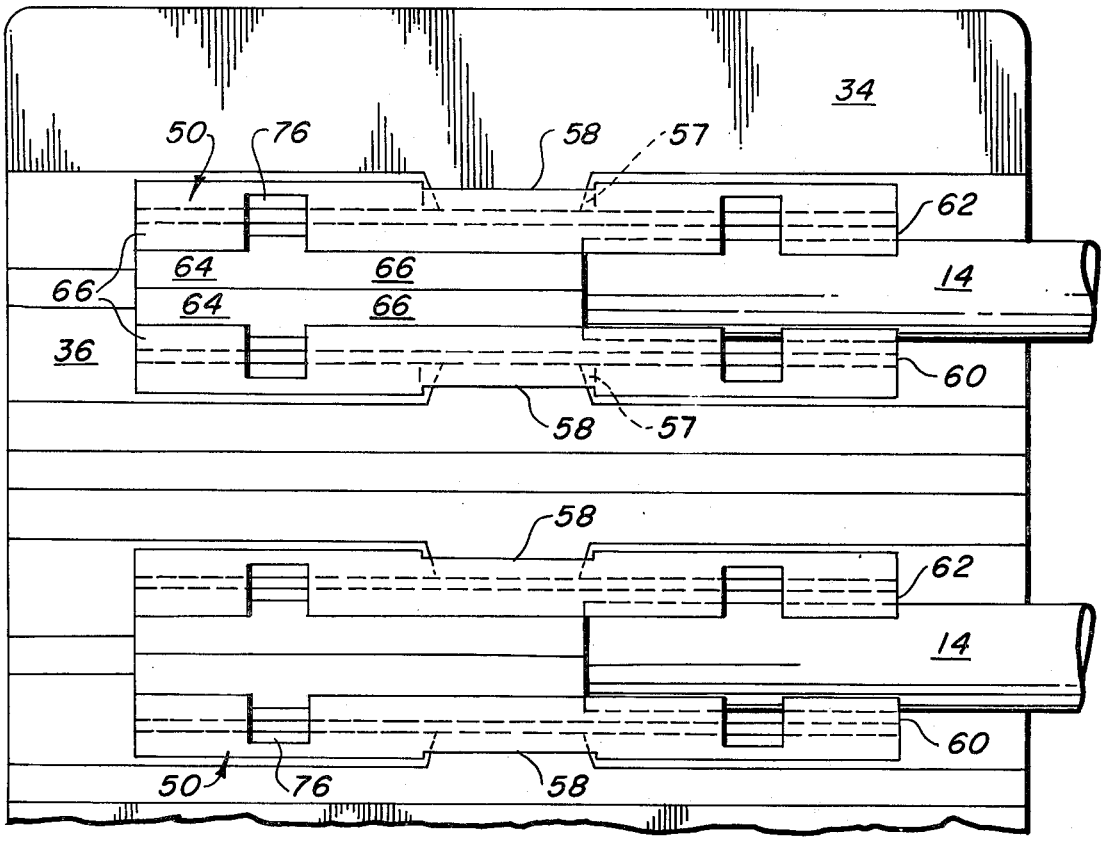
FIG. 2 is a top elevational view of a portion of the spring clip assembly and associated bus bars.

Each recess 44 is generally U-shaped to receive a U-shaped steel spring member 50 extending axially of the bus bars along the recess. The spring member has side legs 52 and 54. The side legs 52 and 54 each have a passage or slot 56 intermediate their ends and a widened portion or cutout 57 in each slot adjacent the central transverse axis as seen in FIG. 5 is provided for snap fit engagement or receipt of a projection 58 on each upper leg 42 adjacent the upper edge of the recess 46 to locate the spring member in the recess in response to insertion of the spring in the recess after first compressing the spring legs.

A pair of metal clips or members 60 and 62 of identical configuration and formed of copper or aluminum or other electrical conducting material are located between each pair of legs 52 and 54 of the spring member 50. Each clip member 60 and 62 includes a longitudinally extending concave surface portion 64 in facing relationship for engaging the respective portion of the cylindrical contour of the bus bars whose ends are received therebetween. A convex formation 66 along the upper edge of each member 60 and 62 extends in opposite directions to form a mouth for faciley receiving a bus bar between the members.

A pair of spaced tabs 68 are provided at the lower edge of a shank portion 70 of each clip member 60 and 62. Each tab 68 is received in a respective passage 72 formed in the back leg 74 of the respective U-shaped spring member 50 and seats in a shallow cutout or recess 73 in the back wall of each recess 46. The end walls of recess 73 intermediate the ends of recess 46 thus form stops against relative longitudinal movement.

In addition each member 60 and 62 has a pair of spaced tabs 76 formed in the concave or arcuate portion 64 and extending outwardly therefrom to seat in a respective passage 78 of the side legs 52 and 54 of a respective U-shaped spring member 50. Thus when a bus bar is seated between members 60 and 62 the members 60 and 62 are forced outwardly against the side legs 52 and 54 of the respective U-shaped spring member 50, while retained along the central axis of the bars by the tabs 68 on shank portion 70 which underlie the bar to ensure the bars are engaged with the clip members 60 and 62 under spring tension.

The back legs of the U-shaped spring members 50 are thus assembled in a respective recess 44 by sliding the same longitudinally until the projections 58 seat in each passage 56 of each leg 52 and 54. The clips or members 60 and 62 are mounted between the side legs 52 and 54 of each spring with tabs 68 and 76 seated in respective passages 72, 73 and 78. The wall 36 of assembly 16 is simply secured to the lower or bottom wall 24 of the extending portion of each U-shaped lower housing assembly 12 by a self tapping screw 46, for example. It will be noted that the parts are symmetrical to facilitate or ease manufacturing and/or assembly problems.

The bus bars 14 are assembled to the respective right housing section 20 and supported therein by respective insulators such as 28, while one end of each bus bar 14 is located between the concave facing surfaces 64 of respective clip members 60 and 62. The bus bar extends to a position adjacent the projections 58 or intermediate the ends of the members 60 and 62 and when inserted forces the clip members 60 and 62 to pivot outwardly against the side legs 52 and 54 of the respective spring member while capturing the shank portion 70 between the bar and back leg 74 of the spring. The spring pressure provided by legs 52 and 54 ensures the required electrical continuity.

The left housing section 22 is then assembled to the right section while the clips are held in position by the tabs 68 and 76 and the spring members are held in place by the projections 58 in the widened portion of the slot 56. It will be noted that other than the fastener 46, it is only necessary to slide or insert the spring members 50 in their respective recesses by first compressing the legs for engaging the respective integrally formed projections and passages; thereafter inserting the clip members 60 and 62 in member 50 to engage the integrally formed tabs and passages and secure the joint assembly whereafter the insertion of the bus bars between the clip members 60 and 62 firmly clamps the bars to the assembly. The bus bars may of course be assembled to the respective housing section 12 before the clip assembly 16, this being a matter of choice. The housing assemblies may then be shipped for use at a desired site.

Thereafter, when it is desired to utilize the housing assemblies to electrically connect the bus bars in tandem or series, the extending end of a left housing section 22 of one housing assembly is brought into registry with the extending end of a right housing section 20 of another housing assembly as seen in FIG. 3 and then engaged therewith by inserting the bus bars 14 between the portions 66 of the clip member 60 and 62 and if necessary forcing them somewhat open until the bars seat in the concave portion 64 at positions spaced longitudinally from the ends of the bus bars 14 in the right housing section. The concave portion 64 and the resiliency of spring member 50 now serve to electrically connect the bus bars 14 in one housing assembly with the bus bars 14 in the other housing section, while the securing of the straps 18 of each housing assembly serves to secure the adjacent housing assemblies to each other. It will be noted that the slot 56 in each leg of spring member 50 enables a portion of each leg to flex independently of the other portion for the purpose of applying spring pressure against a respective portion of clip members 60 and 62 to in turn ensure that the clip members engage the aligned bus bars irrespective of minor misalignments.

The foregoing constitutes a description of a clip assembly for cylindrical bus bars whose inventive concepts are believed set forth in the accompanying claims.

What I claim is:

1. A spring clip assembly for connecting a pair of longitudinally extending bus bars to each other with each bar carried in a respective housing, the improvement comprising;

an insulating member;

means for securing said insulating member in one of said housings;

a U-shaped metal spring member located between said insulating member and one bar carried in said one housing with said spring member extending beyond one end of said one bar;

respective integrally formed means on said insulating member and said spring for securing said spring to said insulating member, a pair of metal clip members each engaged with a respective diametrically opposed portion of said one bar and engaged by said one bar against the legs of said spring member to hold said clip members and spring member engaged with said insulating member against movement transverse to the longitudinal axis of said one bar, said clip members extending beyond the one end of said one bar for receiving the other bar of said pair therebetween to electrically connect said bars; and respective integrally formed means on said spring and clip members interlocking said clip members with said spring member and insulating member.

2. The spring clip assembly claimed in claim 1 in which each of said bus bars has a circular periphery aligned on a common axis and each of said clip members has a concave surface portion in facing relationship to engage the circular periphery of each bus bar at diametrically opposed portions of each bus bar.

3. The clip assembly claimed in claim 2 in which each concave surface portion extends toward the other concave surface portion and a shank portion extends from the respective concave portion with each shank portion located between the back leg of said U-shaped member and said bus bar.

4. The clip assembly claimed in claim 3 in which said means for securing said spring member to said insulating member includes a passage in each leg of said U-shaped spring member intermediate opposite longitudinal ends and a projection on said insulating member for each passage and received in a respective leg passage.

5. The clip assembly claimed in claim 4 in which said interlocking means comprises a pair of passages in the back leg of said U-shaped spring member, a wall on said insulating member located between said passages and a first pair of tabs on the shank portion of each clip member extending through a respective one of said passages and received adjacent opposite ends of said wall.

6. The clip assembly claimed in claim 5 in which said interlocking means comprises a second pair of spaced tabs on each clip member, and respective passages in each leg of said U-shaped member for receiving a respective one of said pair of tabs.

7. The clip assembly claimed in claim 6 in which each tab of said second pair of spaced tabs is formed by bending a portion of each clip member from an edge margin of the respective clip member.

8. A spring clip assembly for connecting a pair of longitudinally extending cylindrical bus bars in end to end relationship with each bar secured in a respective housing against movement transverse to the longitudinal axis of the respective bar; the improvement comprising, an insulating member having a longitudinally extending recess, means for retaining said insulator in one of said housings;

a U-shaped metal spring member in said recess located between said insulating member and one bar secured in said housing with said spring member extending beyond one end of siad one bar, integral means on said insulating member and spring member respectively interlocking said spring member against movement relative said insulating member solely under pressure exerted by said spring;

a pair of clip members located between said base and the legs of said spring member for engagement with diametrically opposed portions of said one bar and engaged by said one bar against the legs of said spring member to hold said clip members and spring member against movement; said clip members extending beyond the end of said one bar for receiving the other bar therebetween, and respective integrally formed means on each clip member and said spring member interlocking said clip members and spring member.

9. The assembly claimed in claim 8 in which said respective integrally formed means interlocking said clip members and spring members comprises a plurality of spaced tabs extending from each clip member and a respective spaced passage in said spring member for retaining each clip member in a predetermined orientation relative each other and said one bus bar.

10. A spring clip assembly for connecting a pair of longitudinally extending bus bars to each other, the improvement comprising;

a housing;

an insulating member secured to said housing;

a generally U-shaped metal spring member having opposite side legs and secured to said insulating member, said insulating member and said metal spring having respective integrally formed means for securing said spring to said insulating member;

a pair of metal clip members;

a bus bar engaged respectively by said metal clip members on diametrically opposed portions of said bus bar, said clip members engaged by said bus bar against the legs of said spring member to hold said clip members and said spring member engaged with said insulating member against movement transverse to the longitudinal axis of said bus bar, said clip members extending beyond one end of said bus bar for receiving the other bus bar of said pair of bus bars therebetween to electrically connect said bus bars; and respective integrally formed means on said spring and clip members interlocking said clip members with said spring member and insulating member.

* * * * *